US008834784B2

(12) United States Patent
MacRae

(10) Patent No.: US 8,834,784 B2
(45) Date of Patent: Sep. 16, 2014

(54) THIN STAVE COOLER AND SUPPORT FRAME SYSTEM

(76) Inventor: Allan J. MacRae, Hayward, CA (US)

( * ) Notice: Subject to any disclaimer, the term of this patent is extended or adjusted under 35 U.S.C. 154(b) by 357 days.

(21) Appl. No.: 13/015,393

(22) Filed: Jan. 27, 2011

(65) Prior Publication Data

US 2012/0193843 A1 Aug. 2, 2012

(51) Int. Cl.
*C21B 7/10* (2006.01)

(52) U.S. Cl.
CPC ..... *C21B 7/10* (2013.01)
USPC ..... 266/193; 266/190

(58) Field of Classification Search
USPC ..... 266/44, 190, 193, 241, 168; 29/428; 165/169, 170; 248/672
See application file for complete search history.

(56) References Cited

U.S. PATENT DOCUMENTS 4,389,041 A * 6/1983 Megerle ..... 266/194
4,437,651 A * 3/1984 Cordier et al. ..... 266/193
4,676,487 A * 6/1987 Kudinov et al. ..... 266/194
5,426,664 A * 6/1995 Grove ..... 373/76
5,904,893 A * 5/1999 Stein ..... 266/46
6,090,342 A * 7/2000 Sumigama et al. ..... 266/193
2004/0256772 A1 * 12/2004 Scharinger et al. ..... 266/193

* cited by examiner

*Primary Examiner* — Scott Kastler
*Assistant Examiner* — Michael Aboagye
(74) *Attorney, Agent, or Firm* — Richard B. Main; Main Cafe

(57) ABSTRACT

A supporting frame and thin stave cooler for a metallurgical furnace comprises a metal structure fastened to the cold face of the thin stave cooler that adds strength and rigidity. The thin stave cooler itself is lightened, thinned, and simplified to take optimal advantage of the supporting frame and its provisions for mounting and attaching the thin stave cooler assembly to the inside walls of a furnace containment shell. Water is circulated in the thin stave cooler through feed and discharge piping connections that pass through the supporting frame and are sleeved by protection sleeves. The protection sleeves can serve as a primary or secondary support system when they are welded between the furnace containment shell and the supporting frame when first installed.

4 Claims, 7 Drawing Sheets

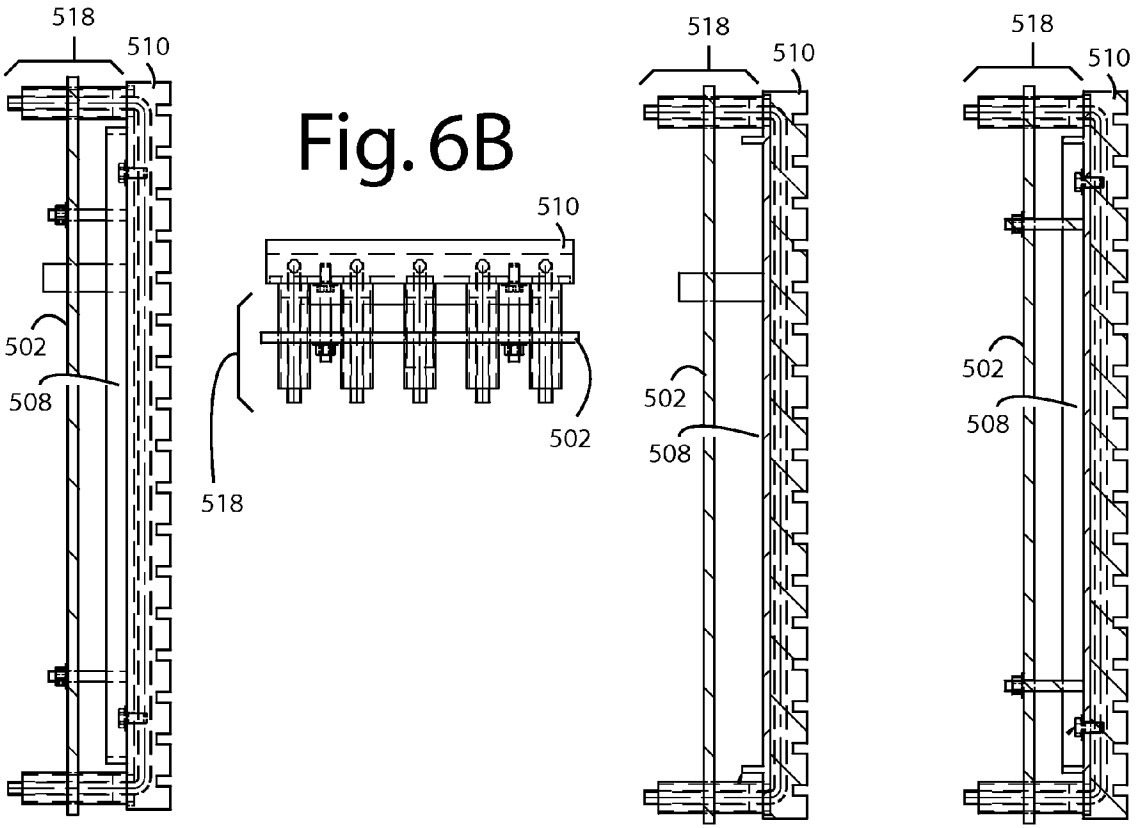
Fig. 6A
Fig. 6B
Fig. 6C
Fig. 6D
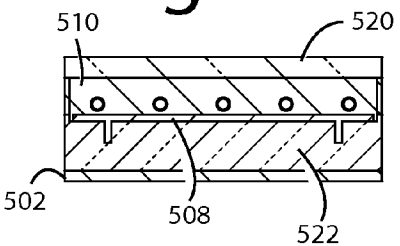
Fig. 6F
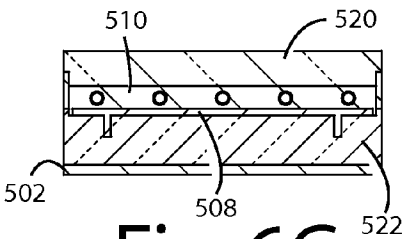
Fig. 6G

THIN STAVE COOLER AND SUPPORT FRAME SYSTEM

BACKGROUND OF THE INVENTION

1. Field of the Invention

The present invention generally relates to stave coolers used with refractory for the interior linings of shaft furnaces, and in particular to thin stave cooler and support frame systems that substantially reduce manufacturing and installation costs.

2. Description of the Prior Art

Metallurgical furnaces are used for the smelting, cleaning, and converting of ore or concentrate for the production of metals. They can also be used to melt or heat metal as in the case of electric arc furnaces for the production of steel. Blast or shaft furnaces used to smelt iron or lead ore are examples of metallurgical furnaces.

Iron-making blast furnaces used in the metallurgical industry enclose the smelting processes inside a vertical cylindrical, steel containment shell. The ore and coke fuel are dropped in from the top and water-cooled nozzle tuyeres inject very hot streams of combustion air in and up from below. Liquid metal drains out the bottom through a taphole, and higher up a mixture of impurities and flux is drawn off through a slag hole.

The bosh is the hottest part of the furnace and is an inverted truncated cone that is closest to the reactions between the coke and the injected blast air. The bosh, barrel, lower stack, and other parts of a blast furnace are subjected to such severe high temperatures inside the steel containment shell would easily melt if it were not protected from the heat.

So modern blast furnaces line the inside surfaces of the steel containment shells with stave coolers made of cast-iron, or more recently of copper. These stave coolers are arrayed together like wall tiles and their cold faces are individually mounted to the inside walls of the containment shell.

Conventional cast-iron and copper stave coolers include their own mounting provisions directly inside the castings or machining of the main body. In the case of copper stave coolers, the added copper material needed to support the weight and loads, and needed to accommodate the mountings can add up to a significant, and unnecessary expense.

Horizontal grooves, pockets, and other kinds of deep textures are often provided on the hot faces of the stave coolers so that they can be lined with refractory brick, castable, or ram. An accretion layer of slag forms over the faces on top of the refractory during operation. Such an accretion layer of slag is important to promote and retain throughout the furnace's campaign life because it provides an important first layer of heat insulation.

Water cooling pipe connections are brought out through holes in the steel containment shell and all the stave coolers are interconnected together and manifolded to a cooling plant to circulate the water. The steel containment shell and piping are sealed so that process gases cannot escape through the water pipe connection holes.

Metal stave coolers are most often manufactured from cast iron or copper, and drilled and plugged copper billets. The cast iron stave coolers are typically used in the upper portion of a blast furnace where the level of abrasion by the charged material is greatest, but the heat loads are relatively low. Copper stave coolers are more expensive, but provide the greater cooling performance necessary in the hottest parts of the blast furnace.

Copper stave coolers are conventionally milled from billet, or cast in molds. The water passages in billet stave coolers are formed by either drilling a cold billet, or by hot forming the holes when the billet is extruded. Such water passages are generally round or oval in cross-section. Beginning and ending cross-connections for water circulation must be drilled into each cooling passage, one feed and one discharge.

The manufacturing of billet copper coolers can require hot working the billet, machining to achieve final outside dimensions, drilling of water passages, additional machining for plugs to close the ends of the drill holes, pre-heating for subsequent welding, welding of the various hole plugs, leak testing, and many other steps. Hot working of copper billets, e.g., by hot rolling or forging, is needed to reduce the grain size of the copper. Large copper grain sizes can result in water leaks and wall thickness defects. Smaller grain sizes improve both the leak tightness and notch toughness of the copper.

Any impurities and residual oxygen in the copper materials can cause porosity and other discontinuities when the copper stave coolers are welded or brazed. So small amounts of deoxidants are usually added to the billet material to minimize any porosity in the weld metal around the hole plugs that would otherwise result.

Billets with water passages formed during a hot extrusion process cannot be hot worked. The water passages would be distorted during the hot working.

Each feed and discharge of a billet cooler needs a connecting pipe or manifold to circulate the cooling water. Conventional connecting pipes for billet copper staves are typically welded to the cold face on the backside of the metal stave cooler. But substantial differential movements that develop between the furnace containment shell and the metal stave coolers during operational heating can cause pipe cracking and leaking of the cooling water. Any corrosion of the cooling pipe and plug weldments can also cause water leakage over time. Such inevitably leads to much shortened campaign lives for coolers built without resolving these issues.

Simply using sand cores to form the water passages can easily result in leaks. So some cast copper and low-alloy copper stave coolers cast-in an internal pipe coil to circulate the water. Without such cast-in pipe coils, leak tightness becomes a problem if the copper crystal grain sizes are too large. Keeping the grain sizes small enough is very challenging and expensive. Using a cast-in pipe coil carries its own set of problems, selecting a proper alloy material and method to use for a cast-in pipe coil are critical because there needs to be an excellent bond between the outside walls of the pipe coil and the copper cast later around it.

The conventional manufacturing of cast copper stave coolers requires many steps, including pattern making, sand filling and firing, melting of copper and addition of deoxidants, transfer and pouring of molten copper, fabrication of pipe coils, setting the pipe coils and other hardware into the mold, fettling of the solidified casting from the mold, removal of excess copper, final machining and testing.

Modern copper foundries are able to match the thermal conductivity of the cast copper to nearly equal that of billet copper used for hot working. Although the resulting grain size of the cast copper is a bit large, leakage is not a concern because an embedded pipe coil is used to circulate the water.

Given stave coolers with equal external dimensions, billet coolers which are not hot worked are the least expensive but the most likely to leak. Billet coolers which have been hot worked are somewhat more expensive and less likely to leak. Cast stave coolers with an internal pipe coil are the least likely to leak and thereby have the longest projected campaign life.

The selection of which stave cooler type to use and its dimensions are driven by commercial as well as technical reasons. Making stave coolers thinner can reduce the final cost to the customer, but thinner stave coolers become weaker. So conventional stave coolers have arrived at a balance between cost and heft.

In order to protect the water pipes as they pass through the furnace containment shell and refractory, protection sleeves, couplings, and pipes are typically installed around the water circulating pipes. These protection devices can complicate the installation of a stave cooler. Such installations can be further complicated by the need to provide adequate vertical and lateral support for the stave cooler inside the furnace containment shell. The tradeoffs invariably involve consideration for the manufacturing costs as well as the installation time, labor, and materials needed in the field.

Vertical coolers or stave coolers for metallurgical furnaces can be flat, curved or bent in either the vertical or horizontal plane, to suit the shape of the crucible. Flat stave coolers are often used in iron making blast furnaces since the diameters of these types of furnaces are so large. The stave coolers may be arranged with gaps between, fit tight to one another, or have overlap joints to prevent the passage of melt or process gases. Stave coolers are also expected to hold and support refractory insulation materials and slag accretions.

SUMMARY OF THE INVENTION

Briefly, a supporting frame and stave cooler embodiment of the present invention for a vertical shaft or stack blast furnace comprises a metal supporting structure fastened to each cold face of each thin stave cooler to add strength and rigidity. The stave cooler itself is lightened, thinned, and simplified to reduce its manufacturing costs by taking optimal advantage of the supporting frame and its provisions for mounting and attaching the stave cooler assembly to the inside walls of a furnace containment shell. Water is circulated in the stave cooler through feed and discharge piping connections that pass through the supporting frame and are isolated by protection sleeves. Such protection sleeves can serve as a primary or a secondary support system when they are welded between the furnace containment shell and the supporting frame when first installed. Such frame and cooler arrangements are easily be adapted to stiffen and support the coolers in the roof and/or walls of most metallurgical furnaces.

These and other objects and advantages of the present invention will no doubt become obvious to those of ordinary skill in the art after having read the following detailed description of the preferred embodiments that are illustrated in the various drawing figures.

IN THE DRAWINGS

FIG. 1 is a functional view diagram of an improved shaft or blast furnace in an exemplary embodiment of the present invention that uses thin stave coolers and supporting frames;

FIGS. 2A, 2B, and 2C are top view, side view, and perspective view diagrams of an entire ring of thin stave coolers in the barrel section of the blast furnace of FIG. 1 just above the bosh, the stave coolers are shown here simply as bare coolers in a single ring row without the supporting frames or any of the refractory that would normally encapsulate most of the components;

Figure 5C:
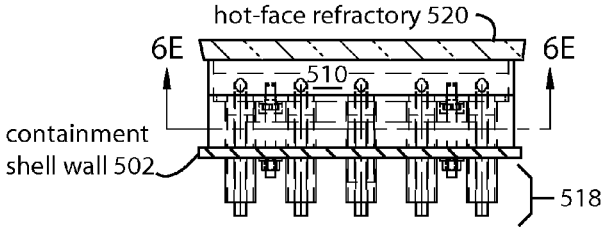
Figure 5A:
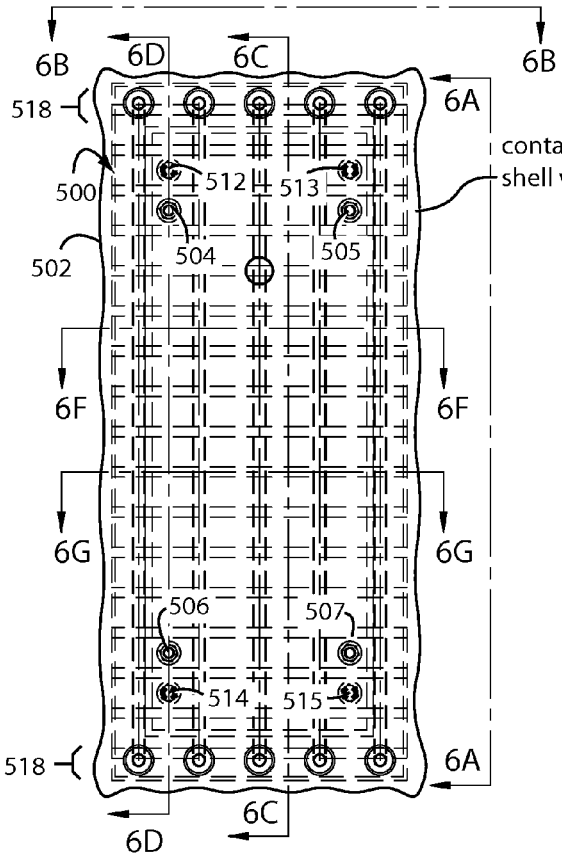
Figure 5B:
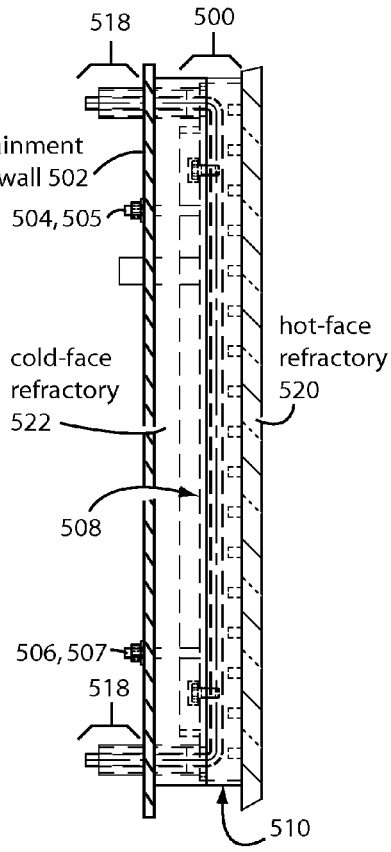
Figure 6E:
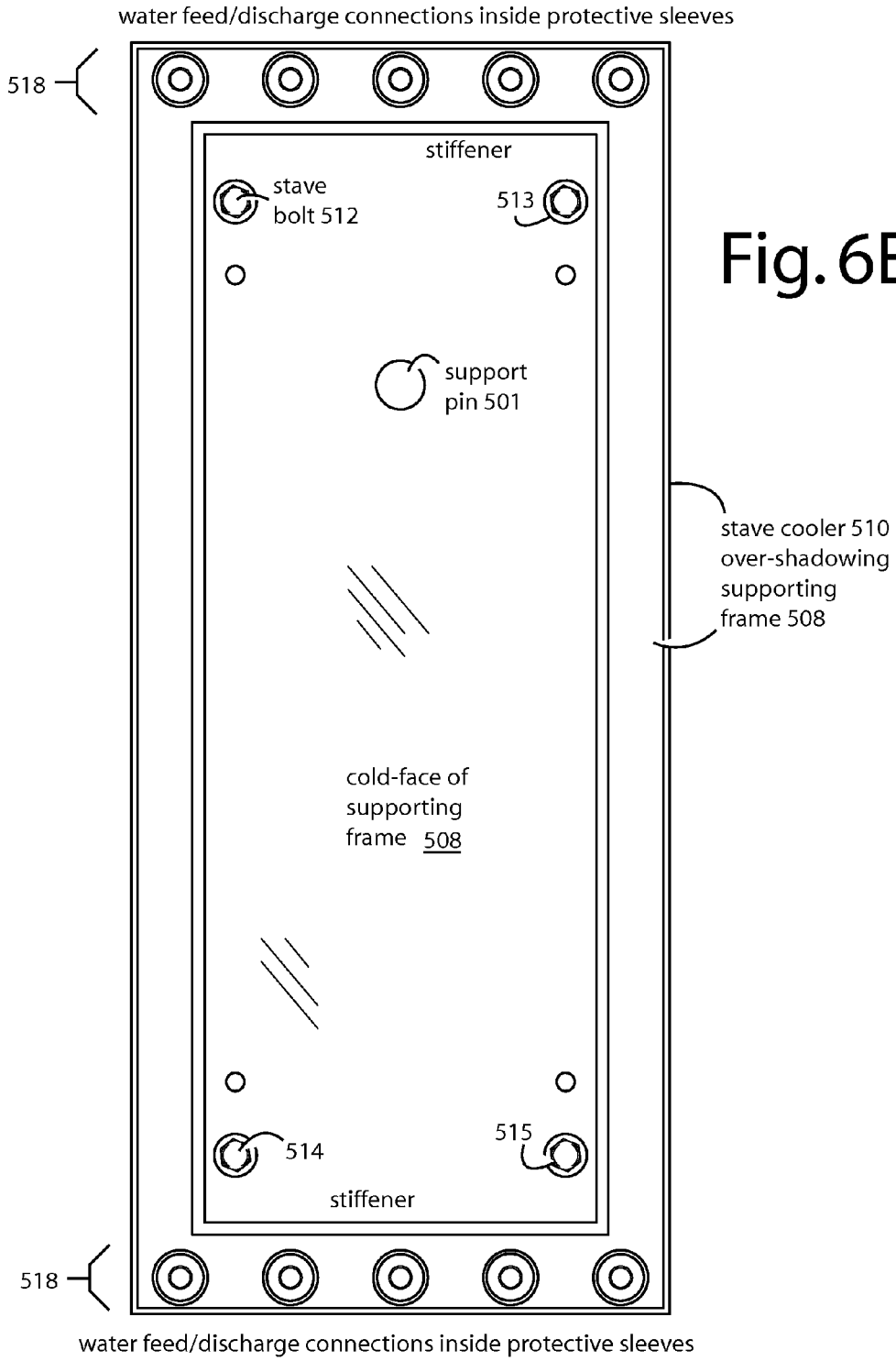

FIGS. 5A, 5B, and 5C are cold-face, side, and top views of a stave plate cast cooler embodiment of the present invention where the illustration includes a whole stave cooler bolted to a matching whole, but slightly smaller supporting frame, and the supporting frame and stave cooler are bolted to the inside of a section of a furnace containment shell. In FIG. 5A the outermost rectangle with dashed lines represents a stave cooler, the next inner rectangle with dashed lines represents a supporting frame. Inside that, the horizontal dashed lines represent grooves on the hot face of the stave cooler, and the vertical dashed lines represent water piping inside the stave cooler; and FIGS. 6A-6G are views of the stave plate cast cooler of FIGS. 5A-5C taken along the lines 6A-6A, 6B-6B, 6C-6C, 6D-6D, 6E-6E, 6F-6F, and 6G-6G, wherein FIG. 6E does not include the rectangular partial section of the furnace containment shell.

DETAILED DESCRIPTION OF THE PREFERRED EMBODIMENT

Figure 1:
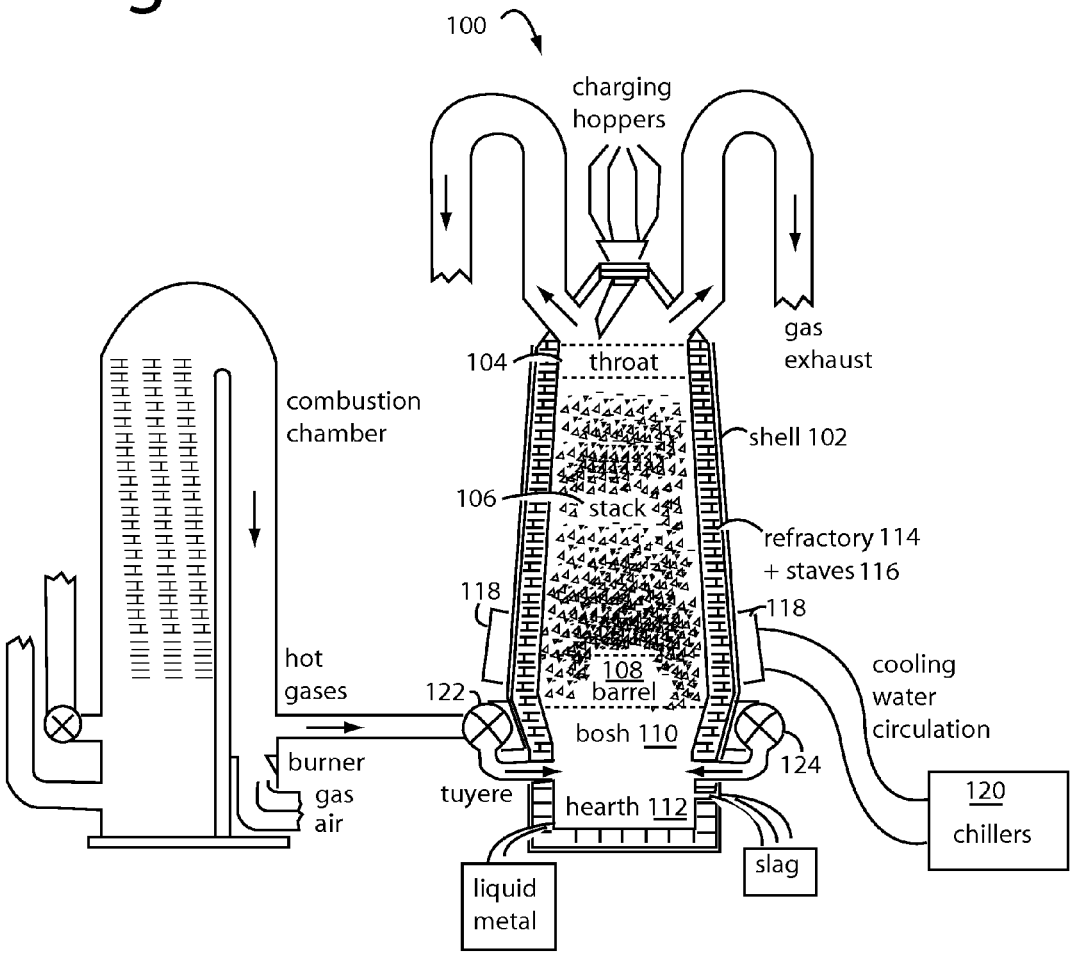

FIG. 1 represents an improved furnace embodiment of the present invention, herein referred to by the general reference numeral 100. A vertical, steel containment shell 102 encloses a throat 104, a stack 106, a barrel 108, a bosh 110, and a hearth 112. The containment shell 102 has an inner lining of refractory 114 and thin stave coolers 116. Some blast furnaces use horizontal plates for coolers, or a combination of staves and plates.

More generally, FIG. 1 represents a steel, furnace containment shell internally provided with stave coolers and a lining of refractory insulation for at least one of a hearth, walls, and roof into which feed material can be introduced and smelted, cleaned, converted, melted, or kept hot.

A piping network 118 circulates cooling water in and through the thin stave coolers 116. A chiller 120 removes the collected heat from the circulating cooling water. Tuyeres 122 and 124 are used to force in super hot combustion gases through water-cooled nozzles into the hearth 112 and bosh 110 areas.

Figure 2C:
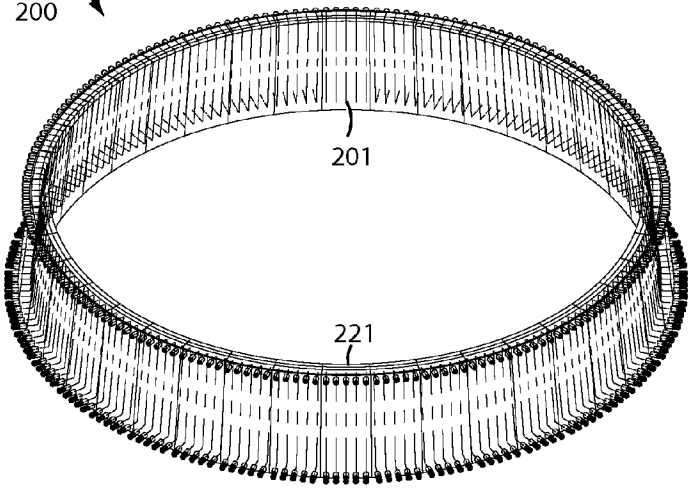
Figure 2B:
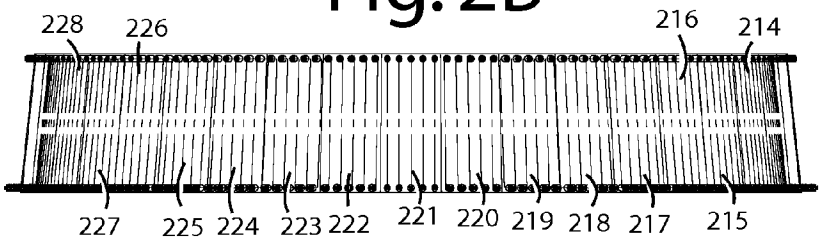
Figure 2A:
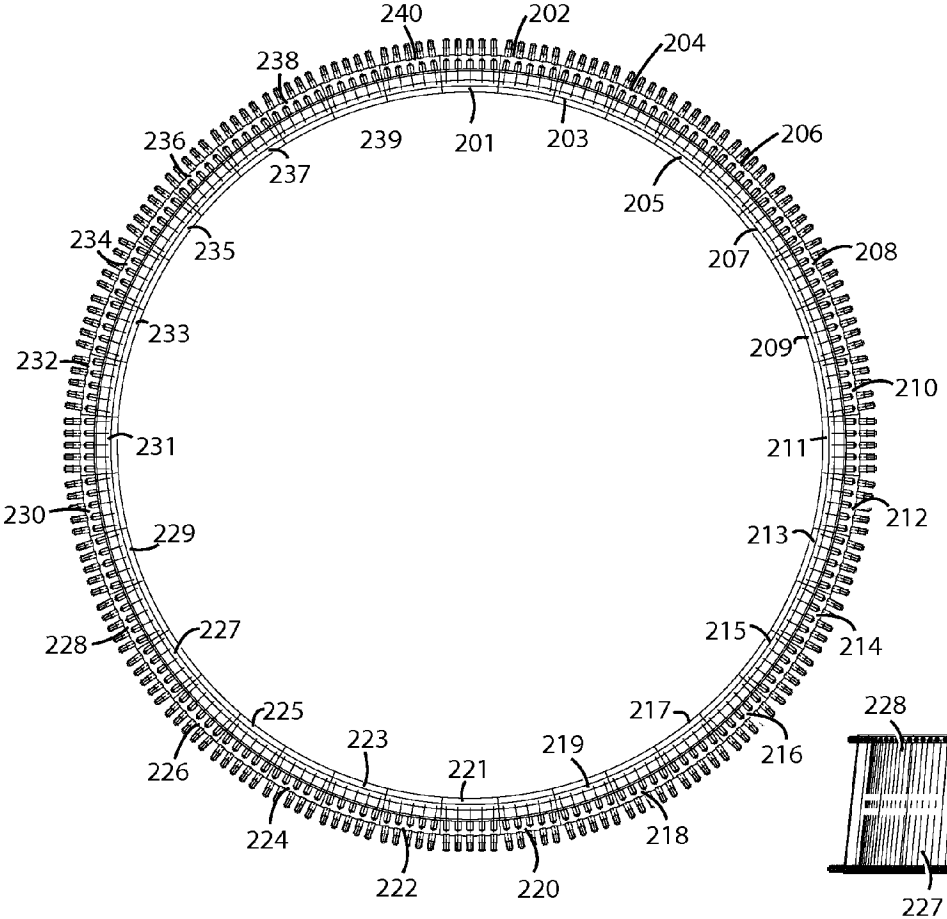

FIGS. 2A-2C provide more of the construction details of the thin stave coolers 116 of FIG. 1. An exemplary barrel section 200 of the improved furnace 100 comprises forty individual thin stave coolers 201-240. As an example, each thin stave cooler has five internal water passages that run vertically and parallel to one another inside a solid cast or drilled copper block body. These features are detailed more fully in FIGS. 3-6. In these examples, each of the internal water passages terminates in individual water feed and discharge connections at opposite ends.

The water feed and discharge connections pass through the containment shell 102 and connect to piping network 118 and chiller 120. The faces, backs, and interstitial gaps between thin stave coolers 201-240 are packed, filled, and covered with refractory, such as castable. Castable is a refractory aggregate mixed with a bonding agent such as aluminous hydraulic cement which will develop its structural strength and set in a mold when added to water.

Figure 3:
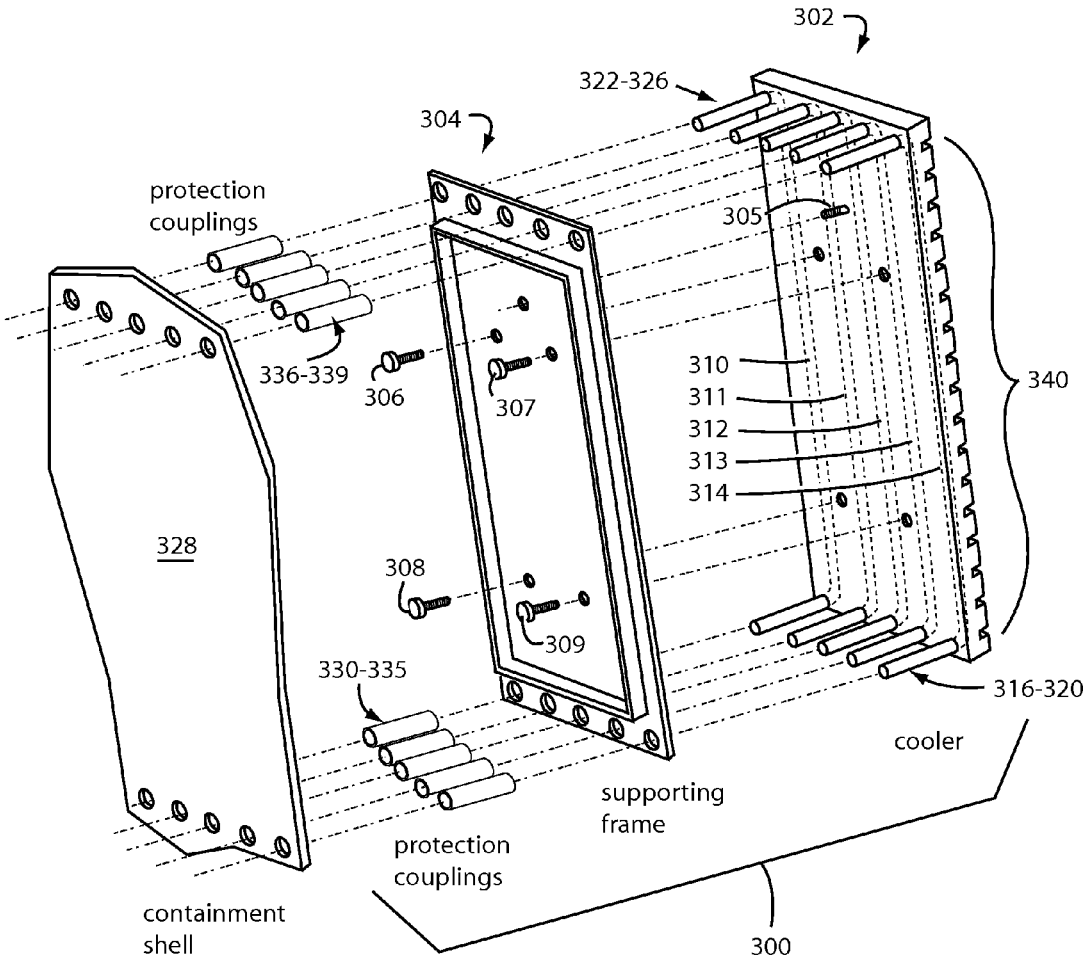
FIG. 3 is an exploded assembly view of a representative one of the thin stave coolers of FIGS. 1 and 2A-2C in which the stave cooler part is backed, strengthened, and rigidized by a supporting frame, and illustrates how the stave cooler is assembled and attaches to the inside walls of the furnace containment shell.

The water feed and discharge piping connections radiate outwards from the tops and bottoms of each thin stave cooler, and are seen more clearly in FIG. 3. Each thin stave cooler 201-240 has a supporting frame fastened to its backside that (a) reduces the amount of metal material necessary to construct the main body of the thin stave cooler and still achieve the same strength and performance goals, and (b) reduces the installation costs of installing the thin stave coolers in a furnace containment shell. The supporting frame is secured to the inside of the containment shell 102 with bolts, welding and other conventional methods, and the whole is sealed to prevent the escape of dangerous hot process gases.

FIG. 3 represents a stave assembly 300 like those represented in FIG. 1 and partially in FIGS. 2A-2C. Stave assembly 300 comprises a thin stave cooler 302 and a supporting frame 304 that are fastened or cast together. Metal thin stave cooler 302 can include a support pin 305 pressed into a hole machined into its cold face to support the stave from either frame 304 or from the containment shell 328. Alternatively, support pin 305 can be used to connect the supporting frame 304 directly to the containment shell and not to the stave cooler. Support pin 305 is typically made of carbon steel. Although supporting frame 304 is shown in FIG. 3 as being bolted to thin stave cooler 302 with machine screws 306-309, other devices are also possible.

Other ways of fastening these two together can also be used, the supporting frame 304 needs to be able to carry the weights and loads transferred from thin stave cooler 302 and simultaneously accommodate differences in the thermal expansion coefficients of the materials involved. A typical cooler will be copper or cast iron, and a typical supporting frame can comprise steel. Pins, notches, ledges, hooks, and other conventional devices can be included to assist in the job supporting thin stave cooler 302.

Here in this example, thin stave cooler 302 comprises a solid copper casting with five parallel, vertical cast-in copper alloy pipes 310-314 that each individually terminate in water feed connections 316-320 and water discharge connections 322-326. Water coolant is circulated during operation through the cast-in copper alloy pipes 310-314 from distribution manifolds external to a containment shell 328.

The water feed connections 316-320 and water discharge connections 322-326 are passed through corresponding holes in the supporting frame 304 and containment shell 328 and need to be sealed and protected by conduits, sleeves or larger pipes. One embodiment of the present invention includes protective sleeves 330-339 that are field or shop welded to the supporting frame 304 at the inner end and to the containment shell 328 at the outer end. These protection sleeves 330-339 can be configured to carry and mount the weight of stave assembly 300 inside the containment shell 328. The protection sleeves 330-339 are not directly attached to thin stave cooler 302, but castable refractory may be packed in all around.

Conventional cast iron stave coolers have used cast-in protection sleeves around their water feed and discharge pipes. Such protection sleeves are commonly rigidly fixed to the furnace containment shells in ways that act as secondary supports to heavy bolts primarily intended to hold the thin stave coolers. Closure rings welded to the water pipes outside are needed to seal and prevent hot process gases from escaping the furnace containment shell from behind the thin stave coolers.

Alternatively, conventional copper thin stave cooler designs have tried welding the protection sleeves to the stave coolers and passing the water pipes out through a flexible compensator or bellows type annular seal. The protection sleeve is surrounded by crushable material and poured castable, and the water pipe is packed inside to seal the opening. However, this method provides no secondary mechanical support of the stave cooler weight and can make installation more complex and costly.

In this example, thin stave cooler 302 has on its hot-face a number of deep, parallel, horizontal grooves 340 intended to help retain refractory block, castable, and/or slag accretions. The groove profiles can be shaped to promote keying of the castable, and a wide variety of shapes have been used in conventional installations. The hot-face and cold-face of thin stave cooler 302 both can be curved or contoured to suit the section of the furnace 100 in which stave assembly 300 is to be installed. Here it is shown flat simply for purposes of illustration and description.

The supporting frame 304 attached to thin stave cooler 302 can be constructed as a solid or a lattice work, and each can further include stiffeners to improve its support strength and rigidity. Several large relief holes can be included in the face of supporting frame 304 to reduce its weight or even to permit metal flow during casting when thin stave cooler 302 is cast in front. The supporting frame 304 can be used to support the pipe coil within a cast stave 302, thereby reducing manufacturing time and cost.

A cast metal stave can be connected to its metal frame using any combination of mechanical or welded fasteners. Metal frames made of carbon steel, stainless steel, nickel alloy, or combination. Metal staves can be drilled and tapped directly to accept a threaded fastener, or a purpose designed piece of metal can be embedded into the casting during the casting process. Such can later be drilled to accept a welded or threaded fastener.

A lifting lug with hole for a hook can be included for hoisting stave assembly 300 into place during initial installation and later during renewal and maintenance. The lifting lug would be removed after it had served its purpose.

The supporting frame 304 may be shorter and narrower than thin stave cooler 302 so it can be overshadowed and protected from the heat loads inside the furnace. The supporting frame 304 can be configured to adapt the thin stave cooler 302 to the inside of the containment shell 328. Protection sleeves 330-339 can be incorporated onto the metal support frame 304 so gas sealing material can be shop installed and tested before shipping stave assembly 300 to the jobsite. Supporting frame 304 can be used to provide a gas seal around water feed and discharge connections 316-326, thereby reducing final machining time, labor and material costs.

Figure 4:
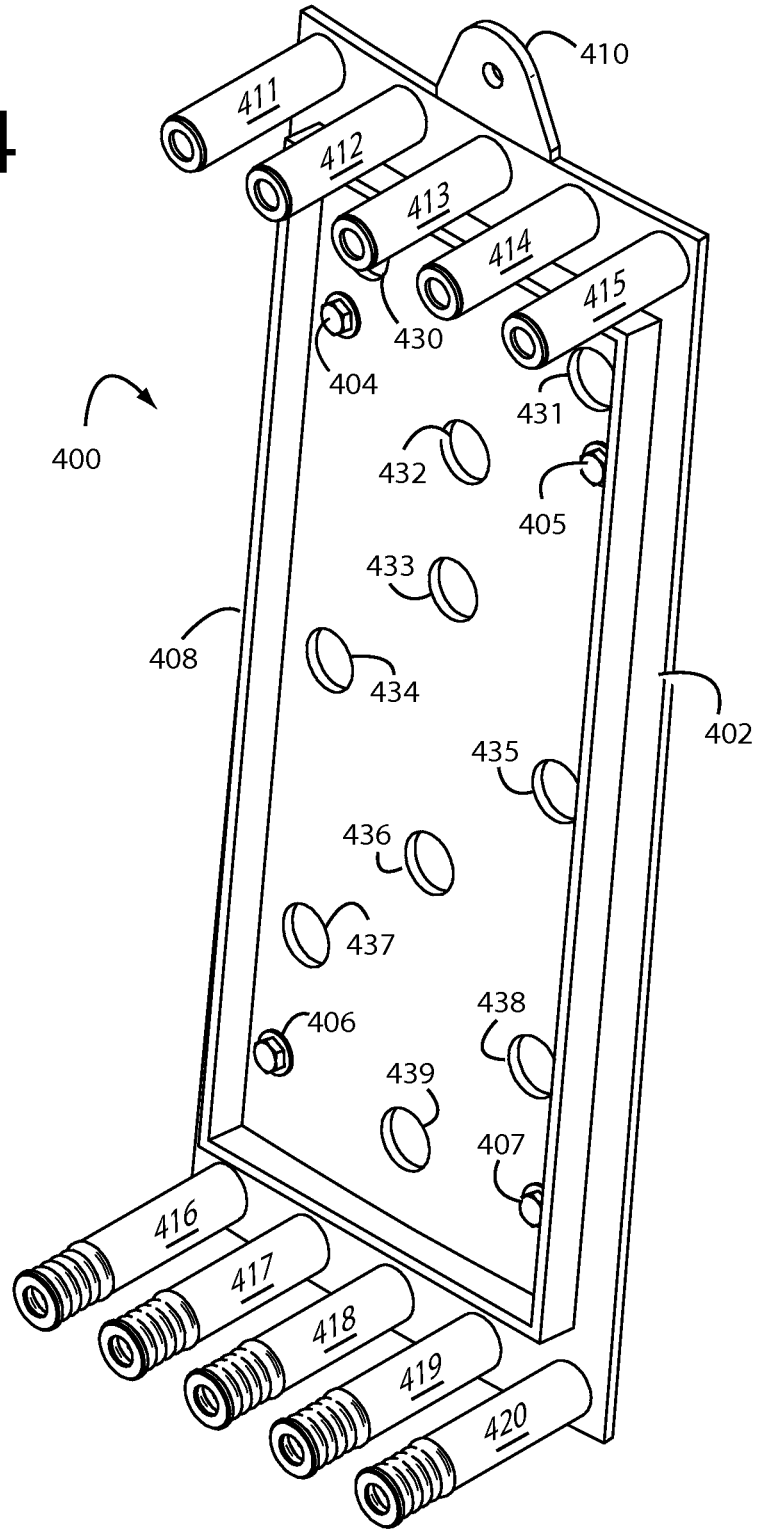
FIG. 4 is a perspective view of a supporting frame in an exemplary embodiment of the present invention that could be used in the improved blast furnace of FIG. 1, with each of the thin stave coolers of FIGS. 2A-2C, and in the assembly of FIG. 3.

FIG. 4 represents a supporting frame 400 in a variation of that shown in FIG. 3. Supporting frame 400 comprises a plate 402 that bolts to a cast copper cooler, e.g., with four fasteners 404-407. Some or all of the bolt holes in plate 402 providing for fasteners 404-407 may be enlarged or slotted to allow for differences in the thermal coefficients of expansion between the iron or steel material of supporting frame 400 and the copper cooler it supports. The supporting frame 400 is preferably constructed of something other than copper or a copper alloy, for example it could be principally fabricated from far less expensive materials like steel or stainless steel.

Alternatively, a box stiffener 408 can be included that will add strength and rigidity to plate 402. Stiffening ribs could also be used instead, depending on the application. A removable lifting tab 410 could be attached to the top end of the supporting frame 400 and plate 402 and to provide a means for a hoist to hook on and lift the thin stave cooler into place during installation and construction of a furnace. The lifting tab is then removed after it has served its purpose. Such provides for a superior installation because ad hoc holes drilled in the field for hoist hooks often corrode and are a source of stave cooler failure. Later, during furnace disassembly, a lifting lug may be reattached.

Two kinds of protection sleeves are shown in FIG. 4, although particular applications will typically use only one of the types. A first kind of protection sleeve 411-415 is a straight section of pipe with a seal welded on its distal end to seal outside the furnace containment shell. It seals around water pipes or pipe-end couplings coming from the thin stave cooler just inside in front of supporting frame 400. A second kind of protection sleeve 416-420 is a straight section of pipe finished with a bellows type annular expansion compensator and a welded-on seal on the distal end. These also seal outside the furnace containment shell around the water pipes coming from the thin stave cooler and provide greater flexibility and reduce the stresses that can cause cracking and metal fatigue of the weldments. An object of including such seals is to prevent the escape of hot process gases through the furnace containment shell that can be a serious hazard to the operators and other equipment.

If the expansion bellows type are used, then additional bolts will be necessary to connect supporting frame 400 to the furnace containment shell.

Installation time and expense can be saved if the protection sleeves are attached to the supporting frame at the shop. Shop installed welds and gas seals often result in a higher quality job and fewer breakdowns.

The refractory applied with the thin stave coolers on the hot face may be brick shapes, castable, or rammed refractory. Refractory between the thin stave coolers, if present, would normally be castable. Refractory behind the thin stave coolers, if present, would also typically be castable. Compressible material can be packed around the protection sleeves or sleeves to adjust when the thin stave cooler thermally expands and contracts.

The hot and cold faces of the thin stave cooler could be flat, curved horizontally, or bent vertically. Many are flat, but cast panels can be flat, conical or cylindrical for the conical portion of a furnace, or cylindrical for the cylindrical portion of a furnace.

Returning again to FIG. 4, supporting frame 400 may include any number of casting or lightening holes 430-439. The supporting frame may or may not be a solid piece of metal, holes can be used to lighten its overall weight. If the holes 430-439 are provided to facilitate casting, the supporting frame 400 is placed at the top of a casting mold and the liquid copper, for example, is poured in from the hot face. As the thin stave cooler solidifies it takes the shape of the supporting frame. The fabricated frame will also reduce requirements for post machining the cold face side of the thin stave cooler when utilized with the cast copper thin stave cooler.

The front, hot-face side of supporting frame 400 is generally fabricated to match the contours of the cold face of a corresponding metal cooler which could be flat, curved or bent. Any fasteners 404-407 used to connect the supporting frame to the metal cooler could be machine threaded screws or welded rivets.

The greater the number of parts which can be shop assembled, the higher the quality and less expensive will be the final product. Time lost to shut downs to install new thin stave coolers can be substantially reduced thereby.

Conventional staves already use support pins, bolting systems, and flexible bellows type compensators to reduce the stresses on the stave and its water pipes. Supporting frame and thin stave cooler embodiments of the present invention minimize the number and expense of such components thus reducing manufacturing costs.

FIGS. 5A-5C represent a stave assembly embodiment of the present invention, and is referred to herein by the general reference numeral 500. Stave assembly 500 is attached to a portion of a containment shell wall 502, e.g., with a support pin 501 to carry the weight and four bolts 504-507. FIGS. 5A-5C show bolts 504-507 as threaded studs welded to a supporting frame 508 and fastened with machine nuts on the outside of containment shell wall 502. A stave cooler 510 is attached to supporting frame 508 with four short machine bolts 512-515. Other means of fastening and attachment are also possible. Water feed and discharge connections from stave cooler 510 are brought outside the containment shell wall 502 through protective sleeves 518. The stave cooler 510 is covered on its hot face by a refractory 520 and behind on its cold face by a refractory 522.

FIGS. 6A-6G also represent stave assembly 500 through various cross sectional views.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the "true" spirit and scope of the invention.

The invention claimed is:

1. An improved blast furnace, comprising:

a steel blast furnace containment shell internally protected with copper stave coolers and a lining of refractory insulation into which feed material can be introduced;

the improvement comprising:

a plurality of individual corresponding steel supporting frames independently fixed to a cold face of a corresponding one of the copper stave coolers thereby forming a stave cooler assembly; and a number of stiffeners attached to each supporting frame configured to increase their individual strength and rigidity;

wherein each stave cooler assembly is individually fastened to the inside the blast furnace containment shell;

wherein each steel supporting frame supports the hanging weight of each said corresponding copper stave cooler and accommodates the thermal loads caused by differences in their coefficients of thermal expansion;

wherein each copper stave cooler is reduced in bulk to less than is otherwise required to support itself without a corresponding steel supporting frame while in use inside said containment shell.

2. A supporting frame, comprising:

an intermediary steel supporting frame having the general flat rectangular outside dimensions and contours of a single corresponding copper stave cooler;

attachments for fastening each steel supporting frame to a cold face of said single corresponding copper stave cooler, wherein the steel supporting frame is constructed to carry the hanging weight of each said corresponding copper stave cooler and to accommodate the thermal loads caused by differences in their coefficients of thermal expansion inside a containment shell of a blast furnace during operation; and a stiffener incorporated into the steel supporting frame and configured to provide increased strength and rigidity individually to each copper stave cooler through its attachment to its corresponding steel supporting frame;

wherein the copper stave cooler is reduced in bulk to less than is otherwise required to support itself without a corresponding steel supporting frame while in use inside said containment shell.

3. The supporting frame of claim 2, further comprising:

a lifting tab attached to a top end of the supporting frame and providing a means for hoisting a copper stave cooler assembly.

4. The supporting frame of claim 2, further comprising:

a number of holes disposed in the metal frame and providing for overall lightening or for enabling the casting of said copper stave cooler together with the metal frame.

* * * * *